US007044464B2

(12) United States Patent
Kamata et al.

(10) Patent No.: US 7,044,464 B2
(45) Date of Patent: May 16, 2006

(54) APPARATUS FOR REVERSING SHEET

(75) Inventors: Tatsuya Kamata, Tokyo (JP); Eiki Marui, Tokyo (JP); Yukihira Takahashi, Tokyo (JP); Masahiko Yamasaki, Tokyo (JP); Osami Katsumata, Himeji (JP); Osamu Ito, Himeji (JP)

(73) Assignee: Glory Kogyo Kabushiki Kaisha, Himeji (JP)

( * ) Notice: Subject to any disclaimer, the term of this patent is extended or adjusted under 35 U.S.C. 154(b) by 288 days.

(21) Appl. No.: 10/648,799

(22) Filed: Aug. 27, 2003

(65) Prior Publication Data

US 2004/0070139 A1 Apr. 15, 2004

(30) Foreign Application Priority Data

Aug. 28, 2002 (JP) ..... 2002-249601

(51) Int. Cl.
*B65H 39/10* (2006.01)

(52) U.S. Cl. ..... 271/291; 271/186; 271/65; 271/902; 399/401

(58) Field of Classification Search ..... 271/291, 271/186, 65, 902; 399/401, 402
See application file for complete search history.

(56) References Cited

U.S. PATENT DOCUMENTS 4,098,551 A * 7/1978 Komori et al. ..... 399/402
4,487,506 A 12/1984 Repp et al.
4,675,514 A 6/1987 Honma et al.
4,693,464 A 9/1987 Honma
4,990,965 A * 2/1991 Kiya ..... 399/402
5,601,281 A 2/1997 Kubodera et al.
5,852,764 A * 12/1998 Kida et al. ..... 399/401

FOREIGN PATENT DOCUMENTS

| | | |
|---|---|---|
| JP | 59-143848 | 8/1984 |
| JP | 2-198946 | 8/1990 |
| JP | 2-225256 | 9/1990 |
| JP | 8-40623 | 2/1996 |
| JP | 9-30706 | 2/1997 |

OTHER PUBLICATIONS

Carter D L; "Improved Forward Reverse Gearbox", *Xerox Disclosure J.*, vol. 23, No. 5, pp. 193-196, Xerox Corp., Stamford, Conn, (Sep. 1998).

* cited by examiner

*Primary Examiner*—Kathy Matecki
*Assistant Examiner*—Thomas Morrison
(74) *Attorney, Agent, or Firm*—Leydig, Voit & Mayer, Ltd.

(57) ABSTRACT

An apparatus for reversing a sheet, such as a banknote, from a front face to a rear face. In the reversing apparatus a first end of a common path communicates with an exit of a first conveyance path, a second end of common path communicates with an exit of a second conveyance path, and the first end of common path communicates with a merging path. Since the merging path is immediately after the common path, no delay is caused in the timing of feeding a banknote into the next processing step, improving reversing process performance. A first reversing roller rotates based on the on or off condition of a first electromagnetic clutch and a second reversing roller rotates based on on or off condition of a second electromagnetic clutch. A banknote can be quickly and surely conveyed in the common path.

2 Claims, 6 Drawing Sheets

APPARATUS FOR REVERSING SHEET

BACKGROUND OF THE INVENTION

1. Field of the Invention

The present invention relates to reversing apparatus used for reversing sheets, such as banknotes, securities or cards, from a front face to a rear face, and vice versa.

2. Related Background Art

Japanese Patent Application Laid-Open No. 09-30706 discloses a conventional technology in the above-mentioned field. The reversing apparatus described in this application comprises a common conveyance path into which a sheet after differentiation between the front and rear faces thereof is conveyed; a reversing pool portion into which the sheet is fed after having been conveyed through the common conveyance path; a stopper disposed so as to open and close at an end point of the reversing pool portion; and a reversing conveyance path extending from a junction between the common conveyance path and the reversing pool portion. The reversing pool portion is used as part of a non-reversing conveyance path during conveyance of a sheet not to be reversed.

However, the reversing pool portion in the conventional reversing apparatus described above includes a conveyance path provided with one entrance and two exits. Therefore, a sheet immediately after discharged from the reversing pool portion is delivered into either of two ways, i.e. the conveyance path for passage of a sheet in a reversed state and the conveyance path for passage of a sheet in a non-reversed state. It is thus necessary to merge the conveyance path for the reversed sheet with the conveyance path for the non-reversed sheet and then feed the sheet into the next processing step. For this reason, the non-reversed sheet conveyance path extending from the reversing pool portion needs to be extended up to the merging part. This results in a delay in timing of feeding the non-reversed sheet discharged from the reversing pool portion, into the next processing step, thus posing a problem that it could hinder improvement in reversing process performance. In such a path configuration or arrangement, the provision of the openable/closable stopper at the end point of the reversing pool portion is also a factor contributing to hindrance to increase of sheet reversing process speed.

The present invention has been accomplished in order to solve the above problem and, particularly, an object of the present invention is to provide sheet-reversing apparatus with improved reversing process performance.

SUMMARY OF THE INVENTION

According to one aspect of the present invention there is provided an apparatus for reversing a sheet conveyed along conveyance paths, the apparatus comprising: a first conveyance path having a first entrance at one end thereof and a first exit at the other end thereof, the first conveyance path for conveying of a sheet to be reversed which is fed into the first entrance; a second conveyance path having a second entrance at one end thereof and a second exit at the other end thereof, the second conveyance for conveying a sheet not to be reversed which is fed into the second entrance; a common path communicating at one end thereof with the first exit of the first conveyance path and communicating at the other end thereof with the second exit of the second conveyance path; a merging path communicating with the one end of the common path; a first reversing roller having a part thereof positioned in the common path; a second reversing roller having a part thereof positioned in the common path, the second reversing roller being opposed to the first reversing roller and pressed against the first revering roller, thereby transferring the sheet in the common path between the first and second reversing rollers; first rotating means for rotating a first rotational shaft integrally extending from the first reversing roller, in one direction; second rotating means for rotating a second rotational shaft integrally extending from the second reversing roller, in the same direction as the first rotational shaft is rotated; a first electromagnetic clutch for coupling the first rotational shaft to the first rotating means; a second electromagnetic clutch for coupling the second rotational shaft to the second rotating means; and control means for effecting an on-off control of the first and second electromagnetic clutches, so that when feeding the sheet from the first conveyance path into the common path, the first electromagnetic clutch is on and the second electromagnetic clutch is off, so that when feeding the sheet from the second conveyance path into the common path, the first electromagnetic clutch is off and the second electromagnetic clutch is on, and so that when feeding the sheet from the common path into the merging path, the first electromagnetic clutch is off and the second electromagnetic clutch is on.

This reversing apparatus has the common path through which the sheet to be reversed and the sheet not to be reversed both can pass, and the common path is provided with two entrances and one exit. Namely, the reversing apparatus of the present invention is constructed on the basis of the path arrangement wherein one end of the common path communicates with the exit side of the first conveyance path, the other end of the common path communicates with the exit side of the second conveyance path, and the one end of the common path communicates with the merging path. Since this path arrangement is provided with the merging path immediately after the common path, there occurs no delay in the timing of feeding the sheet into the next process step. As a result, an improvement is made in the reversing process performance. Furthermore, the first reversing roller undergoes rotation based on on/off of the first electromagnetic clutch and, likewise, the second reversing roller also undergoes rotation based on on/off of the second electromagnetic clutch. When the electromagnetic clutches are provided for the respective reversing rollers in this way, it is easy to achieve control on reversal of the sheet during the reversing operation, as readily understood, and during a period of carrying the sheet not to be reversed, from the second conveyance path into the common path, the sheet can also be fed while being nipped by the reversing rollers, whereby the sheet can be quickly and surely conveyed in the common path, thus achieving fast processing of the sheet.

According to another aspect of the present invention there is provided an reversing apparatus comprising: a first conveyance path for receiving and conveying of a sheet despite of the front face or rear face the sheet; a second conveyance path for conveying the sheet to be reversed, after reversal thereof; a third conveyance path for conveying the sheet not to be reversed, without reversal thereof; a common path communicating at one end thereof with an exit of the first conveyance path, communicating at the one end with an entrance of the second conveyance path, and communicating at the other end thereof with an entrance of the third conveyance path; a first reversing roller having a part thereof positioned in the common path; a second reversing roller having a part thereof positioned in the common path, the second reversing roller being opposed to the first reversing roller and pressed against the first revering roller, thereby transferring the sheet in the common path between the first and second reversing rollers; first rotating means for rotating a first rotational shaft integrally extending from the first reversing roller, in one direction; second rotating means for rotating a second rotational shaft integrally extending from the second reversing roller, in the same direction as the first rotational shaft is rotated; a first electromagnetic clutch for coupling the first rotational shaft to the first rotating means; a second electromagnetic clutch for coupling the second rotational shaft to the second rotating means; and control means for effecting an on-off control of the first and second electromagnetic clutches, so that when a sheet not to be reversed is introduced into the entrance of the first conveyance path, the first electromagnetic clutch is on and the second electromagnetic clutch is off so as to feed the sheet from the first conveyance path through the common path into the third conveyance path, and so that when a sheet to be reversed is introduced into the entrance of the first conveyance path, the first electromagnetic clutch is on and the second electromagnetic clutch is off so as to feed the sheet from the first conveyance path into the common path, thereafter the first electromagnetic clutch is off and the second electromagnetic clutch is on so as to feed the sheet from the common path into the second conveyance path.

This reversing apparatus has the first conveyance path and the common path for passage of the sheet to be reversed and the sheet not to be reversed, and the common path is provided with one entrance and two exits. Namely, the reversing apparatus of the present invention is constructed on the basis of the path arrangement wherein one end of the common path communicates with the exit side of the first conveyance path and with the entrance side of the second conveyance path and wherein the other end of the common path communicates with the entrance side of the third conveyance path. Since this path arrangement has the first conveyance path for accepting both the sheet to be reversed and the sheet not to be reversed, immediately before the common path, the sheet to be reversed and the sheet not to be reversed can be conveyed in a mixed state up to the common path, which simplifies the conveyance path. Furthermore, the first reversing roller undergoes rotation based on on/off of the first electromagnetic clutch and, likewise, the second reversing roller also undergoes rotation based on on/off of the second electromagnetic clutch. When the electromagnetic clutches are provided for the respective reversing rollers in this way, it is easy to achieve the control on reversal of the sheet during the reversing operation, as readily understood, and during a period of carrying the sheet not to be reversed, from the common path into the third conveyance path, the reversing rollers carry on continuously rotating through the electromagnetic clutches, which enables fast reversal of the sheet.

The apparatus is preferably constructed in a configuration wherein the first and second rotating means comprises first and second pulleys, wherein the first pulley is coupled through a first belt to a drive shaft of a motor rotating in one direction, and wherein the second pulley is coupled through a second belt to the drive shaft of the motor. In this configuration, one motor can constantly drive to rotate the pulleys in the same direction. In addition, the driving of the reversing rollers can be implemented by the extremely simple configuration.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DESCRIPTION OF THE PREFERRED EMBODIMENTS

Figure 1:
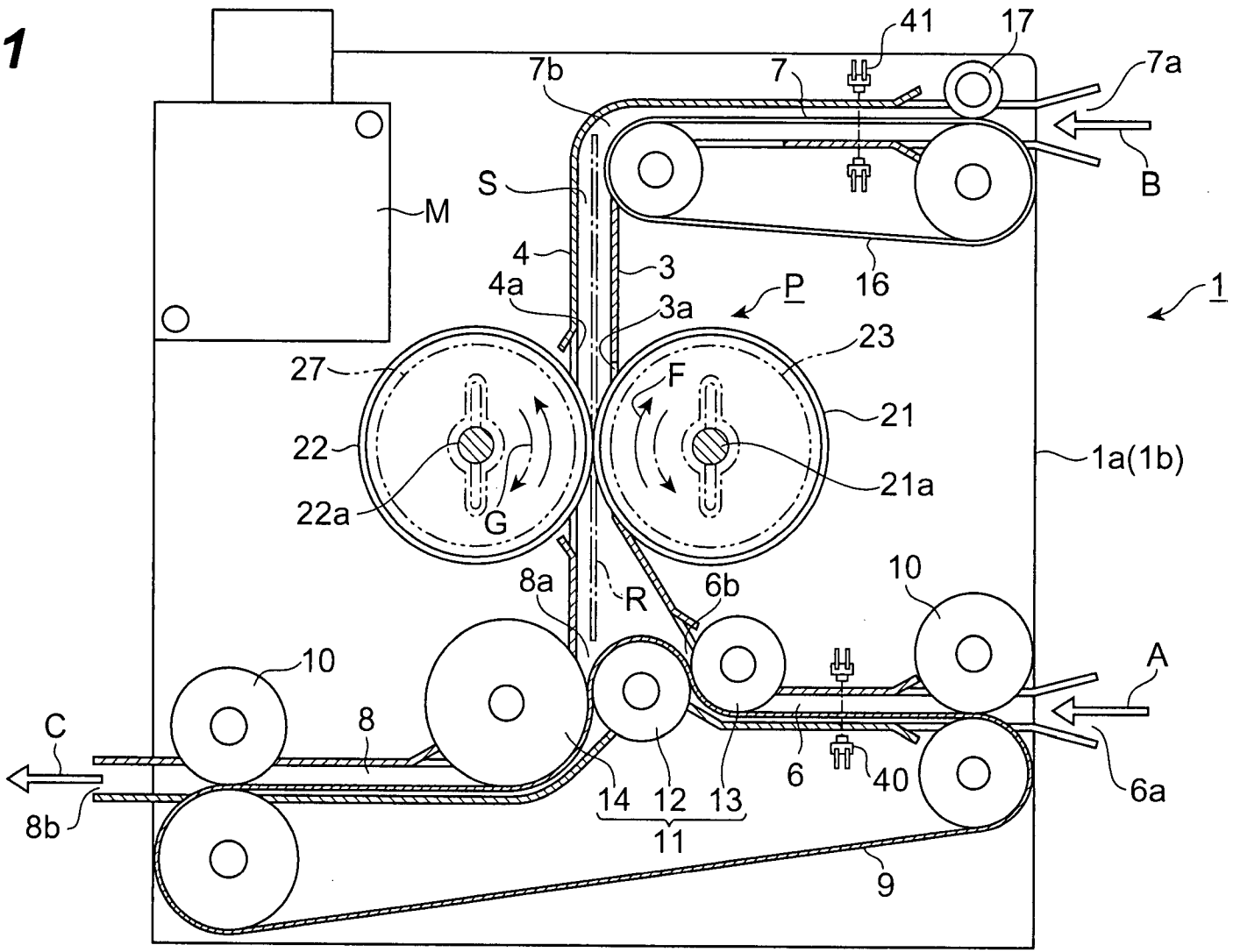
FIG. 1 is a sectional view showing a first embodiment of the reversing apparatus according to the present invention.

In the following description, like reference characters designate like or corresponding parts throughout the drawings. Also in the following description, it is to be understood that such terms as "upper", "lower", and the like, are words of convenience and are not to be construed as limiting terms.

Referring now to the drawings, and particularly, to FIG. 1, there is shown a sectional view of a reversing apparatus in a first embodiment of the present invention being generally designated by the numeral 1. As shown in FIG. 1, the apparatus 1 for reversing sides of a banknote R has conveyance paths along which the banknote R being an example of sheets (e.g., banknotes, securities, or cards) runs at a predetermined speed, between two side plates 1*a*, 1*b* (see FIGS. 2 to 4). A common path S vertically extending and used as a guide passage is provided between the side plates 1*a*, 1*b* which are parallel to each other. The common path S is constructed of first guide plate 3 and second guide plate 4. The guide plate 3 and 4 are spaced at a predetermined spacing from each other, and sandwiched and fixed between the two side plates 1*a*, 1*b*.

The upper and lower ends of the common path (guide path) S are open. The lower end of the common path S is coupled to an exit 6*b* of a first conveyance path 6 which extends in the lower portion of the reversing apparatus 1 for conveying the banknote R to be reversed, and the upper end of the common path S is coupled to an exit 7*b* of a second conveyance path 7 which extends in the upper portion of the apparatus 1 for conveying the banknote R not to be reversed. Furthermore, the lower end of the common path S is coupled to an entrance 8*a* of a merging path 8 located on an extension of the first conveyance path 6.

The first conveyance path 6 and merging path 8 are formed by collaboration of a lower endless belt 9, which horizontally extends below the common path S and which is rotated by drive force of a motor M, with a plurality of guide rollers 10. Feeding-out/feed-in means 11 is disposed under the common path S. The feeding-out/feed-in means 11 is located on the lower end side of the common path S and operates so as to discharge the whole of banknote R from the first conveyance path 6 into the common path S and so as to guide the banknote R present in the common path S, into the merging path 8.

For example, the feeding-out/feeding-in means 11 comprises a feed roller 12 located between the first guide plate 3 and the second guide plate 4 and adapted to rotate in one direction with lower endless belt 9 being stretched thereon; a feeding-out roller 13 pressed against the feed roller 12 through the lower endless belt 9 on the sheet entrance side of the feed roller 12; and feeding-in roller 14 pressed against the feed roller 12 through the lower endless belt 9 on the sheet exit side of the feed roller 12. The feeding-out roller 13 cooperates with the feed roller 12 to constitute a part of the first conveyance path 6, and the feeding-in roller 14 cooperates with the feed roller 12 to constitute a part of the merging path 8.

Thus the banknote R to be reversed, which is fed through the entrance 6*a* of the first conveyance path 6 in a direction indicated by arrow A, is wholly discharged from the first conveyance path 6 into the common path S by means of the feed roller 12 and the feeding-out roller 13. The banknote R fed out of the path 6 and into the common path S is then fed into the merging path 8 by means of the feed roller 12 and the feed-in roller 14 to be discharged in a direction indicated by arrow C, from the exit 8*b*, thus completing the sequential reversing operation.

The second conveyance path 7 for conveyance of banknote R not to be reversed, is formed by collaboration of a guide roller 17 with an upper endless belt 16. The upper belt 16 horizontally extends above the common path S and is adapted to be rotated by drive force of the motor M. The banknote R not to be reversed, which is fed in a direction indicated by arrow B, through the entrance 7*a* of the second conveyance path 7, is wholly discharged from the second conveyance path 7 into the common path S by means of the upper endless belt 16 and the guide roller 17. Thereafter, the leading edge of the banknote R thus fed into the common path S is turned together with rotation of the feed roller 12, the banknote R is then fed into the merging path a by means of the feed roller 12 and the feeding-in roller 14, and thereafter it is discharged in the direction indicated by arrow C from the exit 8*b*, thus completing the sequential non-reversing operation.

As described above, the reversing apparatus 1 has the common path S through which the banknote R to be reversed and the banknote R not to be reversed both pass. The common path S is provided with two entrances 6*b*, 7*b* corresponding to the exits of the first and second conveyance paths 6, 7, and one exit 8*a* corresponding to the entrance of the merging path 8. Namely, the lower end of the common path S communicates with the exit 6*b* of the first conveyance path 6, the upper end of the common path S communicates with the exit 7*b* of the second conveyance path 7, and the lower end of the common path S communicates with the merging path 8. Where the merging path 8 is provided immediately after the common path S in such a manner, no delay is caused in the timing of feeding the banknote R into the next process step, and this results in making an improvement in the reversing process performance.

Furthermore, the apparatus 1 is provided with reversing means P for enabling fast conveyance of banknote R in the common path or guide path S. The reversing means P comprises first reversing rollers 21 disposed on the side of the first guide plate 3, and second reversing rollers 22 disposed on the side of the second guide plate 4. Parts of The first reversing rollers 21 are located in the common path S such that they project out through a roller window 3*a* formed in the first guide plate 3, into the common path S. Likewise, parts of the second reversing rollers 22 are located in the common path S such that they project out through roller window 4*a* in the second guide plate 4, into the common path S. Also the second reversing rollers are opposed to the first reversing rollers 21, respectively. In order to clamp and convey the banknote R with certainty, the first reversing rollers 21 and the second reversing rollers 22 are pressed against each other under a predetermined pressure in the common path S.

Figure 2:
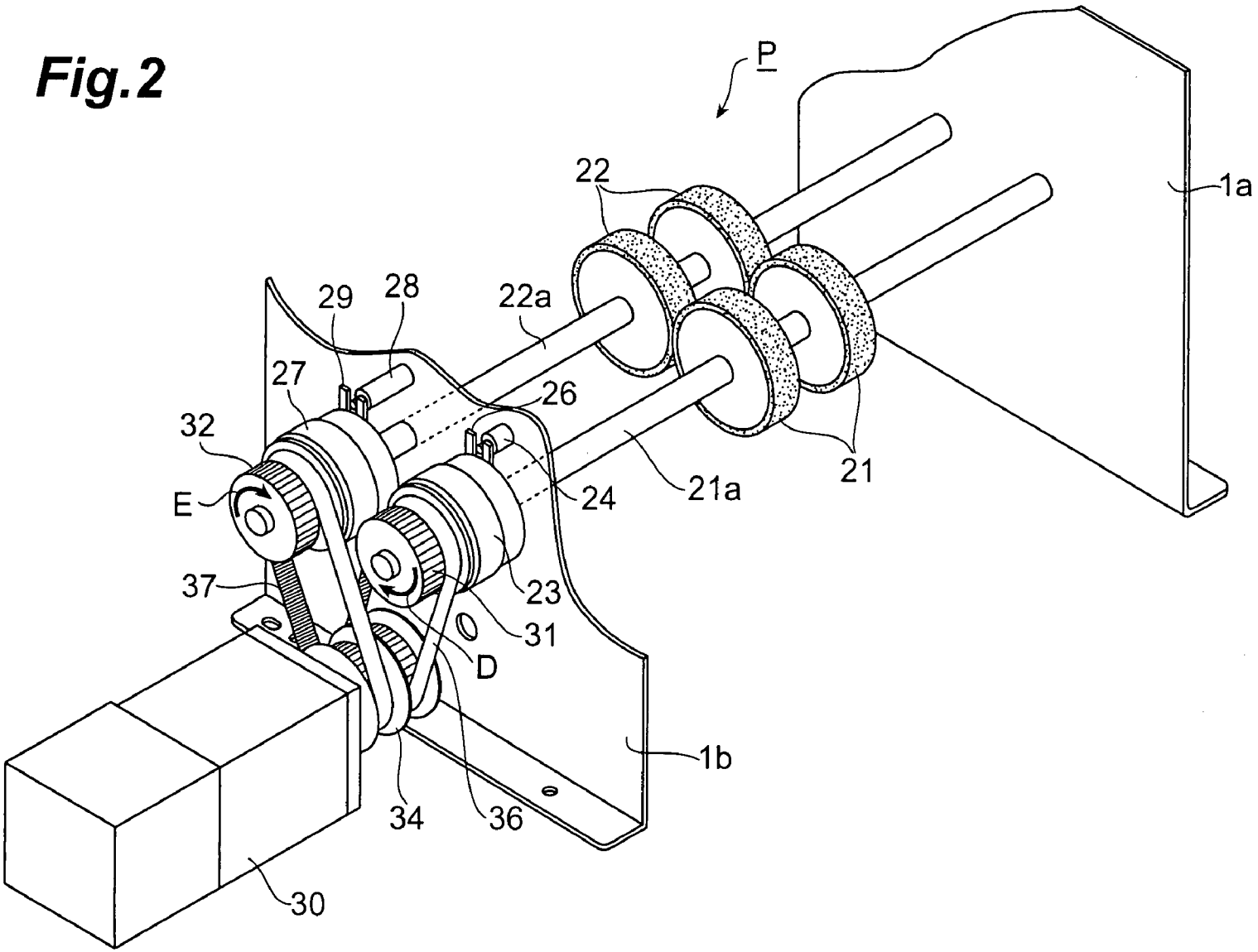
FIG. 2 is a perspective view showing the reversing means in the reversing apparatus shown in FIG. 1.
Figure 3:
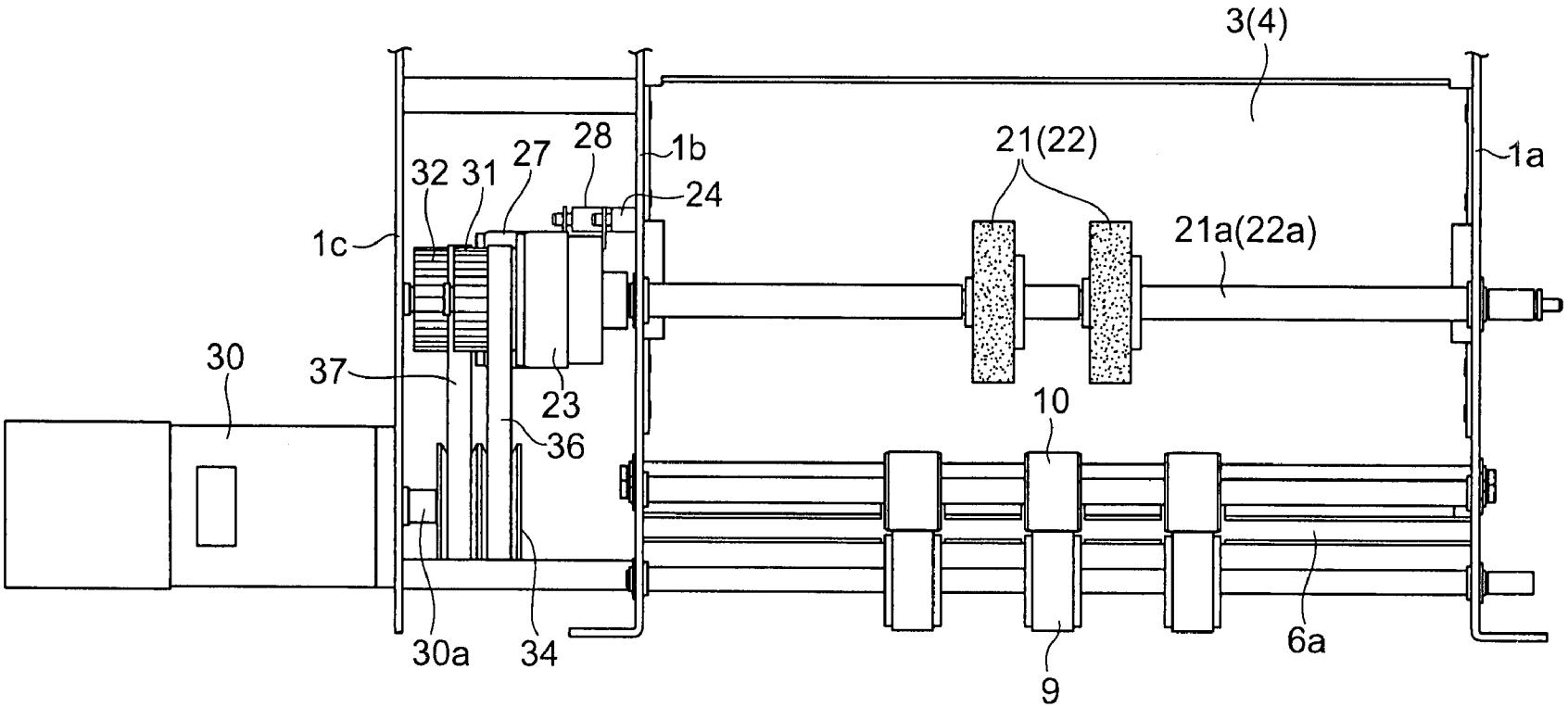
FIG. 3 is a front view of the reversing apparatus shown in FIG. 1.
Figure 4:
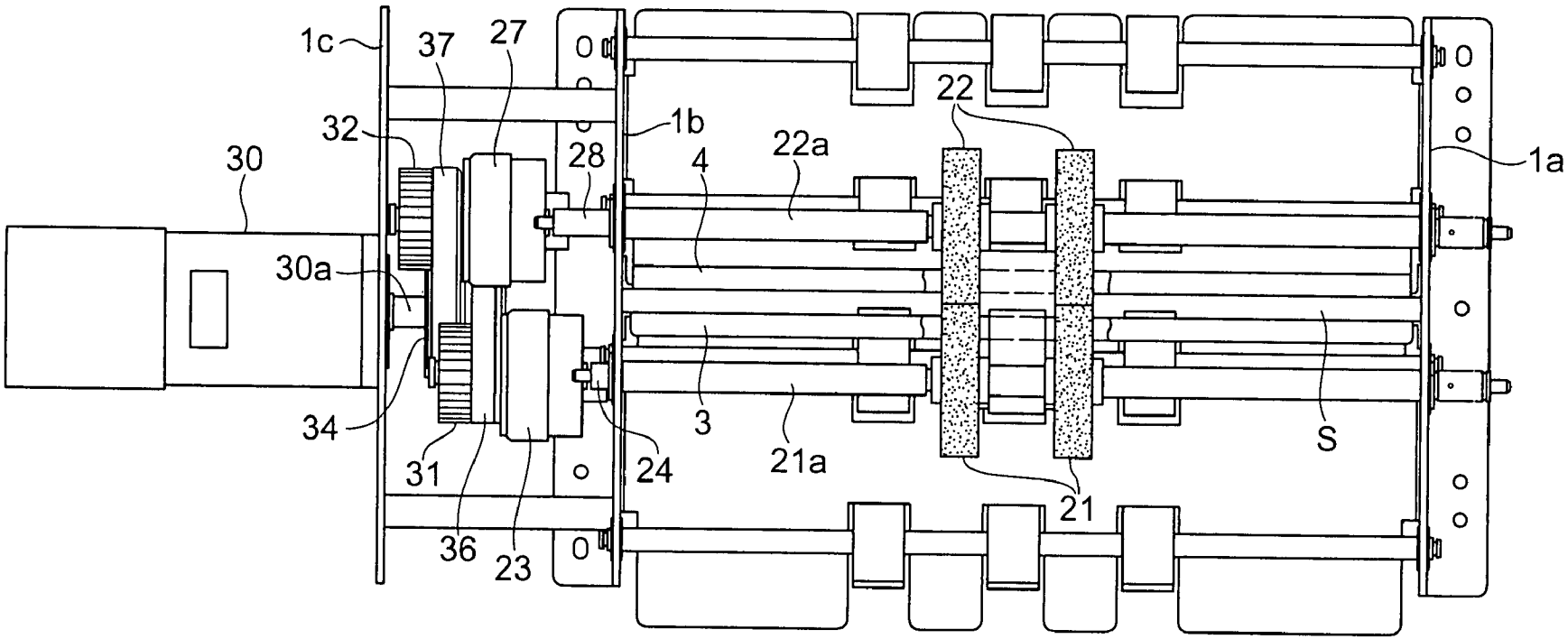
FIG. 4 is a plan view of the reversing apparatus shown in FIG. 1.

As shown in FIGS. 2 to 4, the first reversing rollers 21 are fixed to a first rotational shaft 21*a*. The first rotational shaft 21*a* is journaled through bearings on the side plates 1*a* and 1*b*, and extends horizontally. Furthermore, a first electromagnetic clutch 23 located outside the side plate 1*b* is attached to an end portion of the first rotational shaft 21*a*. The first clutch 23 is under on/off-control by a control signal from a controller (not shown) of the apparatus 1. The first clutch 23 has a detent hook 26 which is engaged with a stop pin 24 standing on the side plate 1*b*, in order to prevent the clutch 23 from rotating.

Similarly, the second reversing rollers 22 are fixed to second rotational shaft 22*a* journaled through bearings on the side plates 1*a* and 1*b*, and the second rotational shaft 22*a* extends in parallel with the first rotational shaft 21*a* and horizontally. A second electromagnetic clutch 27 located outside the side plate 1*b* is attached to an end portion of the second rotational shaft 22*a*. The second clutch 27 is under on/off control by a control signal from the controller of the apparatus 1. Although not shown, the controller is control means for effecting on-off control of each clutches 23, 27, and preferably constructed of a micro-computer. The second electromagnetic clutch 27 has detent hook 29 which is engaged with a stop pin 28 standing on the side plate 1*b*, in order to prevent the clutch 27 from rotating.

Furthermore, a first pulley (first rotating means) 31 is located on an extension of the first rotational shaft 21*a* and coupled through the first electromagnetic clutch 23 to the first rotational shaft 21*a*. The first pulley 31 is a drive force transmitting means for rotating the first rotational shaft 21*a* in one direction during periods in which the first electromagnetic clutch 23 is in an on-state, and always rotates continuously in a direction indicated by arrow D. Similarly, a second pulley (second rotating means) 32 is located on an extension of the second rotational shaft 22*a* and coupled through the second electromagnetic clutch 27 to the second rotational shaft 22*a*. The second pulley 32 is a drive force transmitting means for rotating the second rotational shaft 22*a* in the same direction as the first rotational shaft 21*a* is rotated, during periods in which the second electromagnetic clutch 27 is in an on-state, and always rotates continuously in a direction indicated by arrow E.

Figure 5:
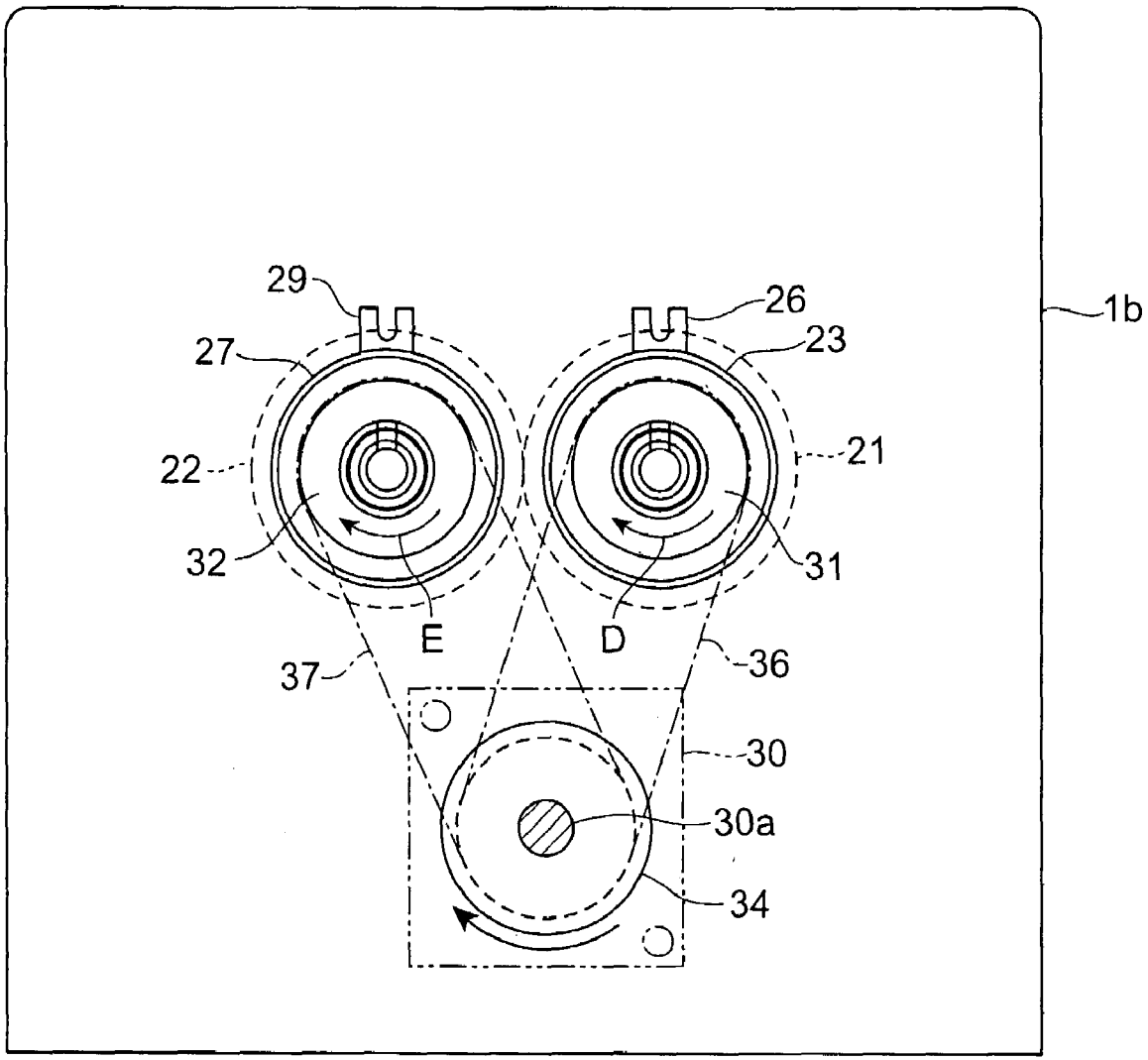
FIG. 5 is a side view showing the positional relation among the first electromagnetic clutch, the second electromagnetic clutch, and the motor.

As shown in FIGS. 2 and 5, a one-way rotating motor 30 fixed to second side plate 1*c* is used for constantly rotating the first pulley 31 and the second pulley 32 in the same direction. A driving pulley 34 is fixed to the drive shaft 30*a* of the motor 30. The driving pulley 34 is coupled to the first pulley 31 through a first timing belt 36. Also, the driving pulley 34 is coupled to the second pulley 32 through second timing belt 37. With this arrangement, it becomes feasible to always rotate the pulleys 31, 32 in the same direction by the single motor 30. In addition, the driving of the reversing rollers 21, 22 is implemented with the extremely simple configuration.

The following is the description of the operation based on the reversing apparatus 1 as described above.

First, the banknote R to be reversed, which is fed in the direction of arrow A through the entrance 6*a* of the first conveyance path 6, is discharged from the first conveyance path 6 into the common path S by means of the feed roller 12 and the feeding-out roller 13. During a period of conveying the banknote R from the first conveyance path 6 into the common path S, the first electromagnetic clutch 23 is controlled in the on-state and the second electromagnetic clutch 27 in the off-state. As a consequence, the first reversing rollers 21 attached to the first rotational shaft 21*a* remain being driven to rotate in the direction of arrow F (see FIG. 1). On the other hand, since the second electromagnetic clutch 27 is in the off-state, the second reversing rollers 22 rotate following the first reversing rollers 21. Therefore, the rotation of the first reversing rollers 21 for a predetermined time results in introducing the banknote R into the common path S by a predetermined length.

After the introduction of the banknote R into the common path S, in order to achieve conveyance alignment of banknote R, the first and second electromagnetic clutches 23, 27 both are controlled in the off-state to temporarily halt the banknote R in the common path S for a predetermined time. Thereafter, upon conveying the banknote R out of the common path S into the merging path 8, the first electromagnetic clutch 23 is switched off and the second electromagnetic clutch 27 is switched on. As a result, the second reversing rollers 22 attached to the second rotational shaft 22*a* are driven to rotate in the direction of arrow G (see FIG. 1). In this time, since the first electromagnetic clutch 23 is in the off-state, the first reversing rollers 21 rotate following the second reversing rollers 22. Therefore, the second reversing rollers 22 rotate for a predetermined time, the banknote R is thus fed in a reversed state into the merging path 8 by the feed roller 12 and the feeding-in roller 14, and the banknote R is discharged from the exit 8*b* in the direction of arrow C, thus completing the sequential reversing operation.

On the other hand, the banknote R not to be reversed, which is fed in the direction of arrow B through the entrance 7*a* of the second conveyance path 7, is discharged from the second conveyance path 7 into the common path S by the upper endless belt 16 and the guide roller 17. Upon conveying the banknote R from the second conveyance path 7 into the common path S, the first electromagnetic clutch 23 is controlled in the off-state and the second electromagnetic clutch 27 in the on-state. As a result, the second reversing rollers 22 attached to the second rotational shaft 22*a* are driven to rotate in the direction of arrow G (see FIG. 1). In this time, since the first electromagnetic clutch 23 is in the off-state, the first reversing rollers 21 rotate following the second reversing rollers 22.

Then the second reversing rollers 22 rotate for a predetermined time, the banknote R is thus fed in a non-reversed state into the merging path 8 by the feed roller 12 and the feeding-in roller 14, and the banknote R is discharged in the direction of arrow C from the exit 8*b*. Since the banknote R can be fed while being clamped between the reversing rollers 21 and 22, the banknote R can be quickly and surely conveyed in the common path S, thus achieving fast processing of the banknote R.

Note that the banknote R is conveyed into the foregoing first conveyance path 6 or second conveyance path 7 after the necessity of reversal thereof is determined and after the width of the banknote R is detected. The numeral 40 denotes a sensor for detecting arrival of banknote R traveling in the first conveyance path 6, and the numeral 41 denotes a sensor for detecting arrival of banknote R traveling in the second conveyance path 7. On the basis of the result of detection by a width detector (not shown), a control signal to achieve synchronization with each arrival sensor 40, 41 is supplied to the first electromagnetic clutch 23 and to the second electromagnetic clutch 27, so as to properly control the rotating directions of the reversing rollers 21, 22.

Figure 6:
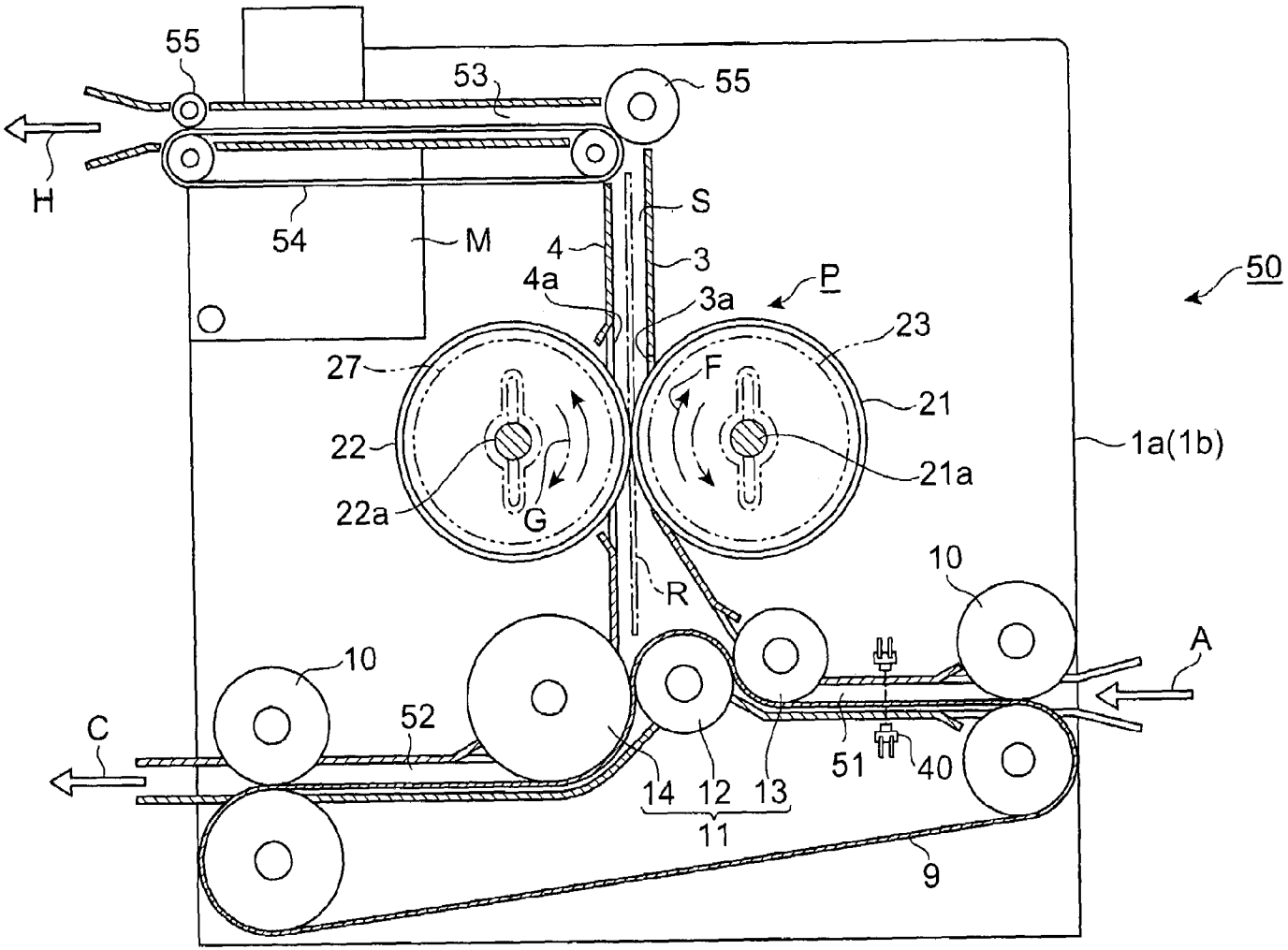
FIG. 6 is a sectional view showing a second embodiment of the reversing apparatus according to the preset invention.

FIG. 6 shows a reversing apparatus 50 in a second embodiment of the present invention. Note that like reference characters designate like or corresponding parts to those in the first embodiment described above, without detailed description thereof.

The reversing apparatus 50 has a first conveyance path 51 and a common path S through both of which the banknote R to be reversed and the banknote R not to be reversed both is conveyed, a second conveyance path 52 through which the banknote R to be reversed is conveyed after having been reversed, and a third conveyance path 53 through which the banknote R not to be reversed is conveyed without being reversed. The common path S is thus provided with one entrance and two exits.

The lower end of the common path S communicates with the exit of the first conveyance path 51 and with the entrance of the second conveyance path 52, and the upper end of the path S communicates with the entrance of the third conveyance path 53. Since the apparatus 50 has the first conveyance path 51 for accepting both the banknote R to be reversed and the banknote R not to be reversed, immediately before the common path S, the banknote R to be reversed and the banknote R not to be reversed can be conveyed in a mixed state up to the common path S, thus achieving simplification of the conveyance path. For conveyance of the non-reversed banknote R, the third conveyance path 53 is formed by collaboration of a guide rollers 55 with an upper endless belt 54 horizontally extending above the common path S and being rotated by drive force of a motor M, and the banknote R is discharged in a direction indicated by arrow H.

Furthermore, the first reversing rollers 21 undergo rotation based on on/off control of the first electromagnetic clutch 23 and, likewise, the second reversing rollers 22 also undergo rotation based on on/off control of the second electromagnetic clutch 27. In this control, upon feed the banknote R from the first conveyance path 51 into the common path S, the first electromagnetic clutch 23 is switched on and the second electromagnetic clutch 27 is off. When the banknote R is one not to be reversed, the first electromagnetic clutch 23 is maintained in the on-state and the second electromagnetic clutch 27 is continuously maintained in the off-state, in order to convey the banknote not to be reversed, from the common path S into the third conveyance path 53.

On the other hand, when the banknote R is one to be reversed, the first electromagnetic clutch 23 is off and the second electromagnetic clutch 27 is switched on, in order to convey the banknote to be reversed, from the common path S into the second conveyance path 52. When the electromagnetic clutches 23, 27 are provided for the respective reversing rollers 21, 22 in this way, it is easy to achieve the control on the reversal of banknote R during the reversing operation, as readily understood. Also, upon conveying the banknote not to be reversed, from the common path S into the third conveyance path 53, the reversing rollers 21, 22 carry on being continuously rotated through the electromagnetic clutches 23, 27, thus enabling fast reversal of banknote R.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

What is claimed is:

1. An apparatus for reversing a sheet conveyed along conveyance paths, said apparatus comprising:

a first conveyance path;

a second conveyance path;

a third conveyance path;

a common path communicating at a first end with an exit of said first conveyance path, communicating at said first end with an entrance of said second conveyance path, and communicating at a second end with an entrance of said third conveyance path;

a first reversing roller having a part positioned in said common path;

a second reversing roller having a part positioned in said common path, said second reversing roller being opposed to said first reversing roller and pressed against said first reversing roller, thereby transferring a sheet in said common path between said first and second reversing rollers;

first rotating means for rotating a first rotational shaft in a first direction, said first rotation shaft integrally extending from said first reversing roller;

second rotating means for rotating a second rotational shaft in the first direction, said second rotational shaft integrally extending from the second reversing roller;

a first electromagnetic clutch coupling said first rotational shaft to said first rotating means;

a second electromagnetic clutch coupling said second rotational shaft to said second rotating means; and control means for effecting on-off control of said first and second electromagnetic clutches, so that, when a sheet not to be reversed is introduced into an entrance of said first conveyance path, said first electromagnetic clutch is on and said second electromagnetic clutch is off to feed the sheet from said first conveyance path, through said common path, and into said third conveyance path, and when a sheet to be reversed is introduced into the entrance of said first conveyance path, said first electromagnetic clutch is on and said second electromagnetic clutch is off to feed the sheet from said first conveyance path into said common path, and, thereafter, said first electromagnetic clutch is off and said second electromagnetic clutch is on to feed the sheet from said common path into said second conveyance path.

2. The apparatus according to claim 1, wherein said first and second rotating means comprise first and second pulleys, said first pulley is coupled through a first belt to a drive shaft of a motor rotating in the first direction, and said second pulley is coupled through a second belt to the drive shaft of the motor.

* * * * *